US006704949B2

(12) United States Patent
Waldman et al.

(10) Patent No.: US 6,704,949 B2
(45) Date of Patent: Mar. 16, 2004

(54) COMBINATION BASSINET, CHANGING TABLE AND BEDSIDE SLEEPER

(75) Inventors: Kenneth C. Waldman, New York, NY (US); Jerome Dropinski, Reading, PA (US)

(73) Assignee: Simplicity, Inc., Reading, PA (US)

( * ) Notice: Subject to any disclaimer, the term of this patent is extended or adjusted under 35 U.S.C. 154(b) by 154 days.

(21) Appl. No.: 10/103,580

(22) Filed: Mar. 21, 2002

(65) Prior Publication Data

US 2003/0177574 A1 Sep. 25, 2003

(51) Int. Cl.[7] ..... A47D 7/02; A47D 7/04; A47D 11/00

(52) U.S. Cl. ..... 5/93.1; 5/93.2; 5/95; 5/98.1; 5/99.1; 5/105; 5/11

(58) Field of Search ..... 5/93.1, 93.2, 95, 5/98.1, 99.1, 101, 102, 105, 106, 107, 655, 424, 426, 11; 16/34

(56) References Cited

U.S. PATENT DOCUMENTS

| | | | | | |
|---|---|---|---|---|---|
| 141,918 | A | * | 8/1873 | Carpenter | 5/106 |
| 287,721 | A | * | 10/1883 | Ranney | 5/106 |
| 472,647 | A | * | 4/1892 | Walker | 5/95 |
| 484,975 | A | * | 10/1892 | Perry | 5/11 X |
| 548,005 | A | * | 10/1895 | Miller, Jr. | 5/11 X |
| 620,069 | A | | 2/1899 | Cobb | 5/95 |
| 732,618 | A | * | 6/1903 | Collier | 5/11 X |
| 744,993 | A | * | 11/1903 | Barta | 5/105 |
| 962,767 | A | * | 6/1910 | Lawyer | 5/95 |
| 1,138,451 | A | | 5/1915 | Bugele | 5/95 |
| 1,200,830 | A | * | 10/1916 | Goss | 5/95 |
| 1,267,244 | A | | 5/1918 | McMillan | 5/95 |
| 1,283,169 | A | | 10/1918 | Hasson | 5/99.1 |
| 1,920,580 | A | * | 8/1933 | McGlauthen | 5/99.1 |
| 2,291,233 | A | * | 7/1942 | Karlik | 5/93.1 |
| 2,461,609 | A | | 2/1949 | Light | 280/31 |
| 2,574,559 | A | * | 11/1951 | Graf et al. | 5/11 |
| 2,632,186 | A | | 3/1953 | Berk et al. | 5/99.1 |
| 2,691,176 | A | | 10/1954 | Saldana | 5/93.1 |
| 2,716,439 | A | | 8/1955 | Feist | 280/7.1 |
| 3,427,666 | A | | 2/1969 | Saxe | 5/2.1 |
| 3,670,344 | A | * | 6/1972 | Boudreau | 5/11 |
| 3,896,513 | A | * | 7/1975 | Boucher et al. | 5/99.1 |
| 4,715,075 | A | * | 12/1987 | Shamie | 5/93.1 |
| 4,967,432 | A | | 11/1990 | Kujawski et al. | 5/98.1 |
| 5,013,086 | A | | 5/1991 | Benzur | 297/272.1 |
| 5,148,561 | A | | 9/1992 | Tharalson et al. | 5/95 |
| 5,161,484 | A | * | 11/1992 | Duane | 5/95 X |
| 5,172,435 | A | | 12/1992 | Griffin et al. | 5/95 |

(List continued on next page.)

FOREIGN PATENT DOCUMENTS

| | | | | |
|---|---|---|---|---|
| GB | 5334 | * | 2/1911 | 5/95 |
| GB | 1578716 | * | 11/1980 | 5/99.1 |

*Primary Examiner*—Robert G. Santos
(74) *Attorney, Agent, or Firm*—Volpe and Koenig, P.C.

(57) ABSTRACT

A combination bassinet, bedside sleeper and changing table apparatus including a supporting frame having a rocking feature convertible through adjustable locking casters for easy rolling. A fabric member comprised of sidewalls and a skirt is draped over the frame. The apparatus may be placed against one side of an adult bed for easy access by a parent. The bedside sleeper is secured to the parents' bed with safety straps. One sidewall may be lowered to facilitate access to an infant by removal of a removably mounted sidewall/skirt supporting rod. The apparatus is adjustable in height to align the bedside sleeper with the parents' bed and when used as a changing table to accommodate for differences in the height of the parent. The bassinet is provided with a removable, adjustable hood for shielding light from the baby's eyes. The apparatus comprises a skeletal structure covered with a soft, aesthetically pleasuring and yet sturdy cloth which is easily removable and washable and includes two convenient storage areas.

32 Claims, 10 Drawing Sheets

U.S. PATENT DOCUMENTS

Figure 1A:
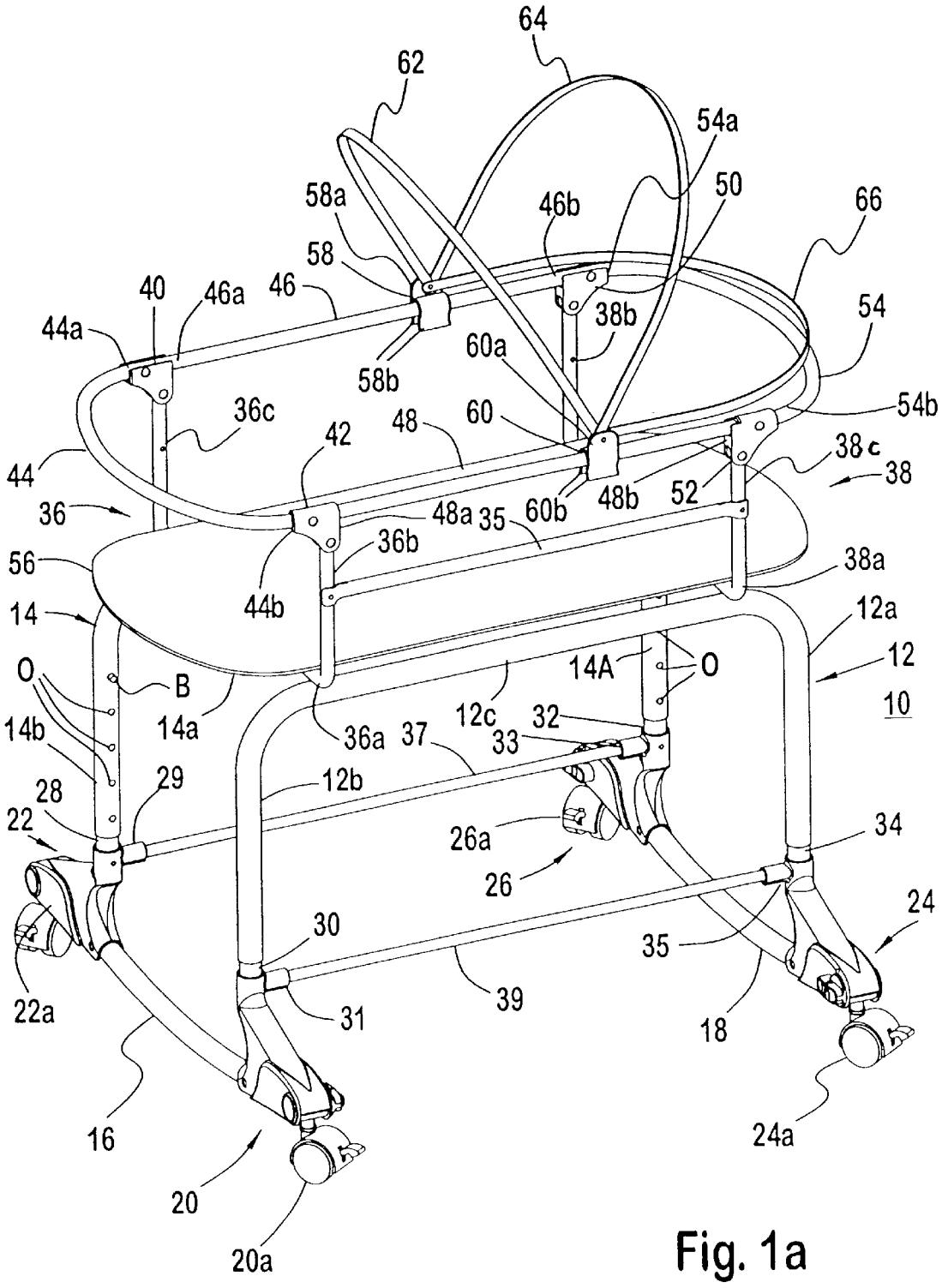

| | | | | | |
|---|---|---|---|---|---|
| 5,293,655 | A | | 3/1994 | VanWinkle et al. | 5/95 |
| 5,339,470 | A | | 8/1994 | Shamie | 5/98.1 |
| 5,349,709 | A | | 9/1994 | Cheng | 5/93.1 |
| 5,375,294 | A | | 12/1994 | Garrett | 16/34 |
| 5,430,899 | A | | 7/1995 | Chisholm | 5/95 |
| 5,553,336 | A | | 9/1996 | Mariol | 5/93.1 |
| 5,581,827 | A | | 12/1996 | Fong et al. | 5/98.1 |
| 5,604,941 | A | * | 2/1997 | Roman | 5/95 |
| 5,636,853 | A | | 6/1997 | Huang | 280/30 |
| 5,778,465 | A | | 7/1998 | Myers | 5/99.1 |
| 5,822,817 | A | | 10/1998 | Carew et al. | 5/732 |
| 5,845,349 | A | * | 12/1998 | Tharalson et al. | 5/99.1 |
| 5,867,850 | A | | 2/1999 | Mariol | 5/93.2 |
| 5,963,998 | A | | 10/1999 | Carew et al. | 5/655 |
| 6,079,063 | A | | 6/2000 | Cheng | 5/98.1 |
| 6,112,347 | A | | 9/2000 | Tharalson et al. | 5/95 |
| 6,123,091 | A | | 9/2000 | Flynn et al. | 135/96 |
| 6,148,456 | A | | 11/2000 | Tharalson et al. | 5/99.1 |
| 6,173,462 | B1 | | 1/2001 | Huang et al. | 5/655 |
| 6,202,228 | B1 | | 3/2001 | Cox | 5/95 |
| 6,341,394 | B1 | | 1/2002 | Wang | 5/105 |
| 6,470,515 | B1 | | 10/2002 | Hsia | 5/99.1 |
| 6,526,608 | B1 | | 3/2003 | Hsia | 5/99.1 |
| 6,539,563 | B1 | | 4/2003 | Hsia | 5/93.2 |
| 6,550,082 | B2 | | 4/2003 | Tharalson et al. | 5/95 |
| 6,578,211 | B2 | | 6/2003 | Tharalson et al. | 5/93.2 |
| 6,588,033 | B1 | | 7/2003 | Welsh, Jr. et al. | 5/99.1 |
| 2002/0078498 | A1 | | 6/2002 | Cheng | 5/93.1 |
| 2002/0083524 | A1 | | 7/2002 | Tharalson et al. | 5/95 |
| 2002/0092094 | A1 | | 7/2002 | Welsh, Jr. | 5/95 |
| 2002/0152550 | A1 | | 10/2002 | Tharalson et al. | 5/95 |
| 2002/0166169 | A1 | | 11/2002 | Longenecker et al. | 5/93.1 |
| 2003/0126681 | A1 | | 7/2003 | Tharalson et al. | 5/93.2 |

* cited by examiner

COMBINATION BASSINET, CHANGING TABLE AND BEDSIDE SLEEPER

BACKGROUND

The present invention relates to baby cribs and more particularly to a novel three-in-one crib arrangement capable of functioning as a bassinet, changing table and bedside sleeper.

SUMMARY

It is not uncommon for families having an infant to provide a separate bassinet, changing table and bedside sleeper. Obviously all of these units occupy space and can make an infant's room quite confining, especially in instances where the infant's room is small. Also, the costs of these units can be prohibitive to many potential customers The present invention is characterized by comprising an apparatus in which all the capabilities of bassinet, changing table and bedside sleeper are integrated into one unitary apparatus which is capable of being changed over quite simply and quite readily.

The apparatus of the present invention comprises a lightweight and yet sturdy and stable skeletal structure which is designed to function as a rocking bassinet when the casters provided thereon are drawn in from the rolling position. The housings for the casters extend well beyond the curved rocking members to limit the degree of rocking and thereby provide added stability for the structure. The casters, when lowered, allow the structure to be easily rolled and are also capable of being locked in the "down" position when it is desired to prevent the structure from rolling.

Swingably mounted hoops (i.e. gussets) are provided for adjustably supporting a hood to cover the baby's eyes from light, which swingable hoops are capable of being lowered to gain total access to the surface supporting the infant.

A section of the top support of the skeletal structure is removable to gain access to the interior of the bedside sleeper when positioned adjacent to parent's bed or when used as a changing table. Nevertheless, a safety bar is provided to act as a barrier to prevent the child from easily rolling out of the bedside sleeper. The sleeper is secured to the parents' bed by safety straps which are placed beneath the mattress and preferably between the mattress and the bedspread to assure safe, secure attachment of the bedside sleeper to the parents' bed.

The skeletal structure is covered with a lightweight, durable, washable fabric which is designed to provide an aesthetic exterior appearance. The cover includes a side storage bag and larger underside storage area to provide adequate room for diapers, baby clothes and other items such as powders, salves, ointments, creams and the like typically advantageously provided in close proximity to a changing table.

The skeletal supporting structure is adjustable preferably to at least four different heights to align the structure to the parents' bed when used as bedside sleeper and also when used as either a changing table or bassinet, to accommodate the height of the person attending to the infant.

The entire structure is extremely light in weight and easy to use and yet quite rugged and stable and is easily and quickly assembled and disassembled for compact storage, transportation and use.

It is therefore one object of the present invention to provide a novel apparatus capable of functioning as a bassinet, changing table and bedside sleeper requiring very minor adjustment to convert to any one of the above functions.

Still another object of the present invention is to provide a novel apparatus capable of functioning as a bassinet, changing table and bedside sleeper and which is comprised of a skeletal superstructure which is lightweight and yet strong, rugged and stable and which is covered by a lightweight, sturdy, washable, aesthetically pleasing fabric which, in addition to accommodating the baby, is provided with accessible storage areas respectively located to one side and the underside of the apparatus.

The above as well as other objects of the present invention will become apparent when reading the accompanying description and drawings in which:

BRIEF DESCRIPTION OF THE DRAWING(S)

Figure 1B:
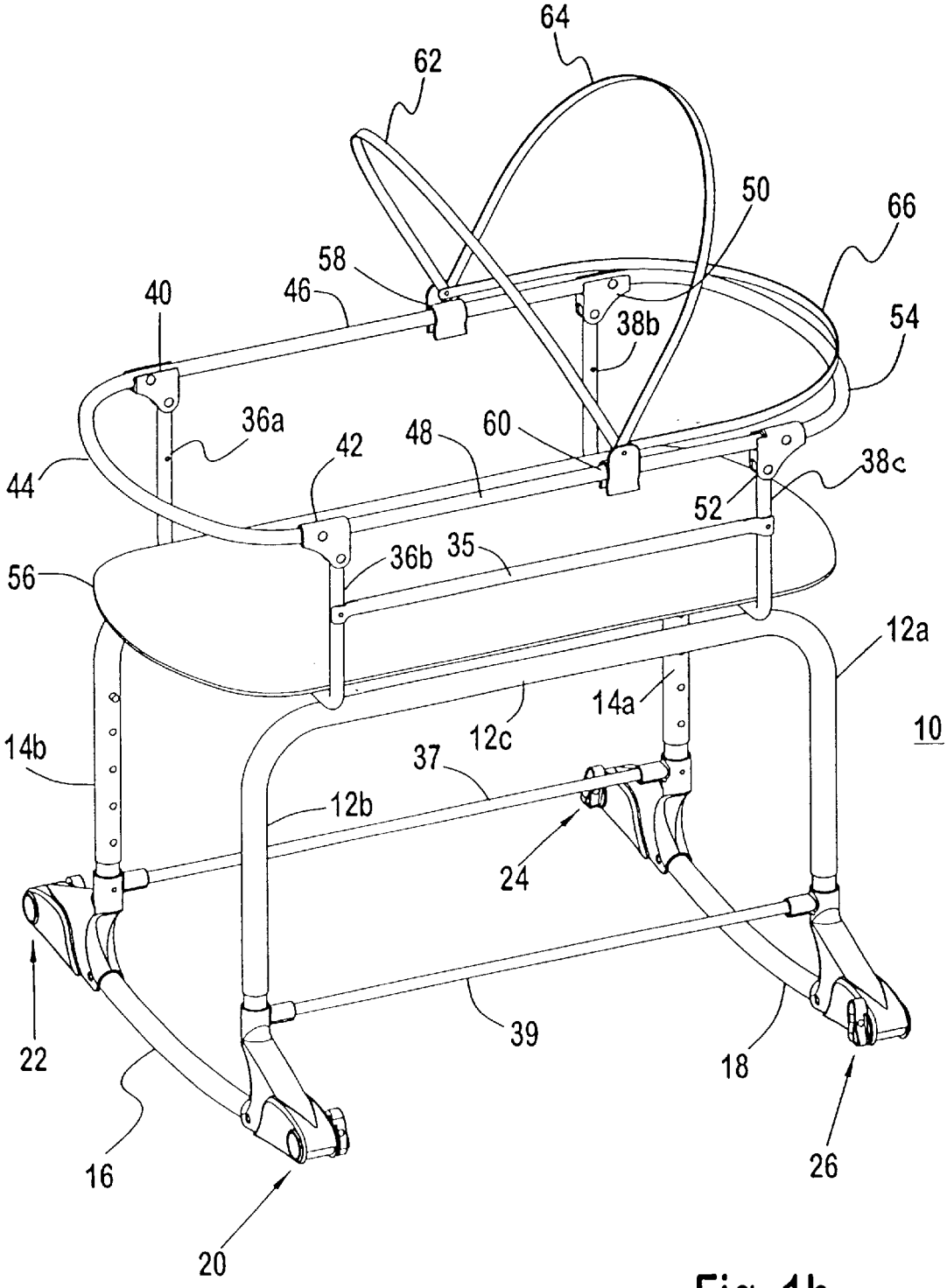

FIGS. 1*a* and 1*b* are perspective views respectively showing the skeletal structure of the present invention with the casters in the supporting and concealed position.

Figure 1C:
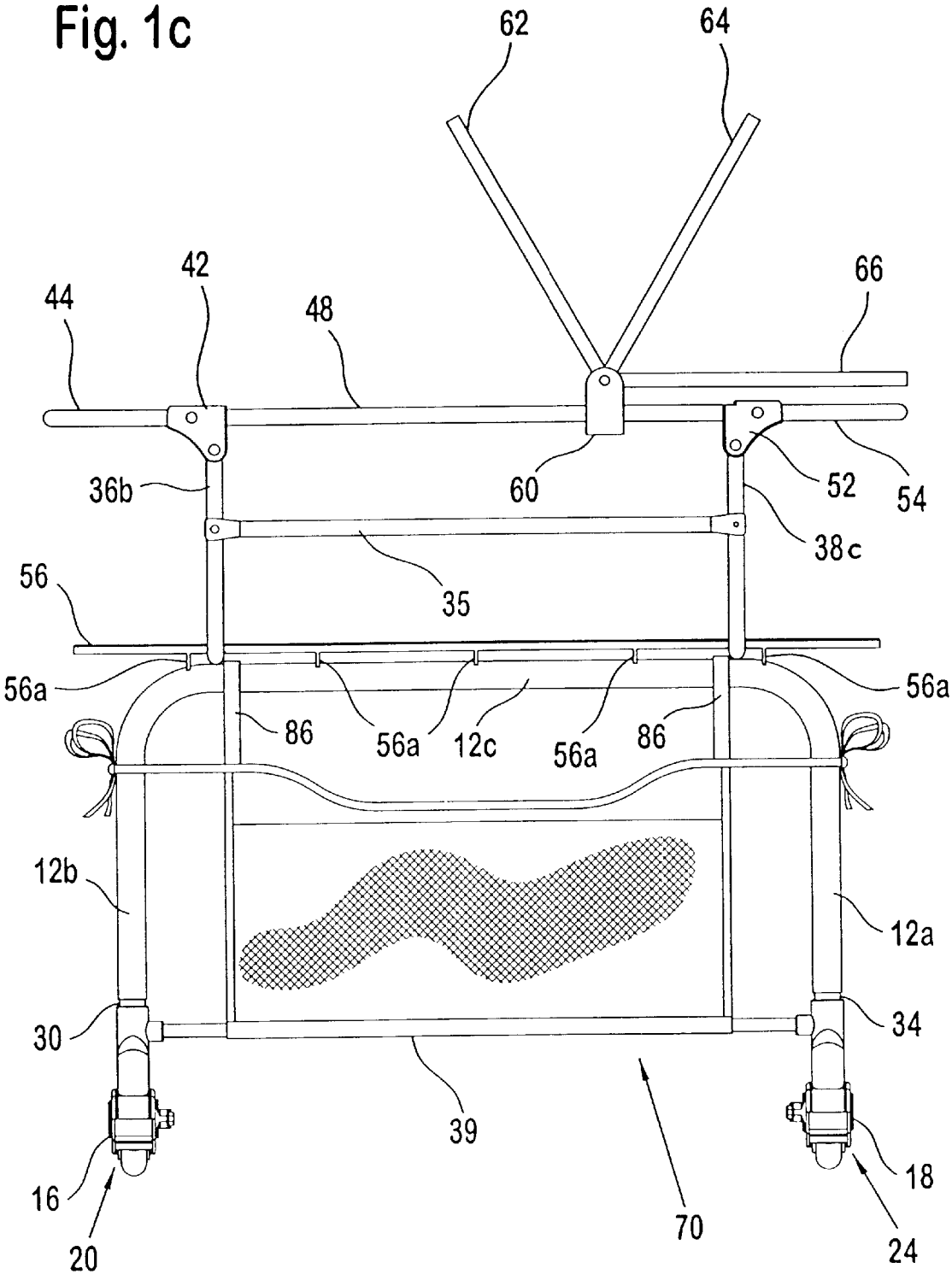
Figure 1D:
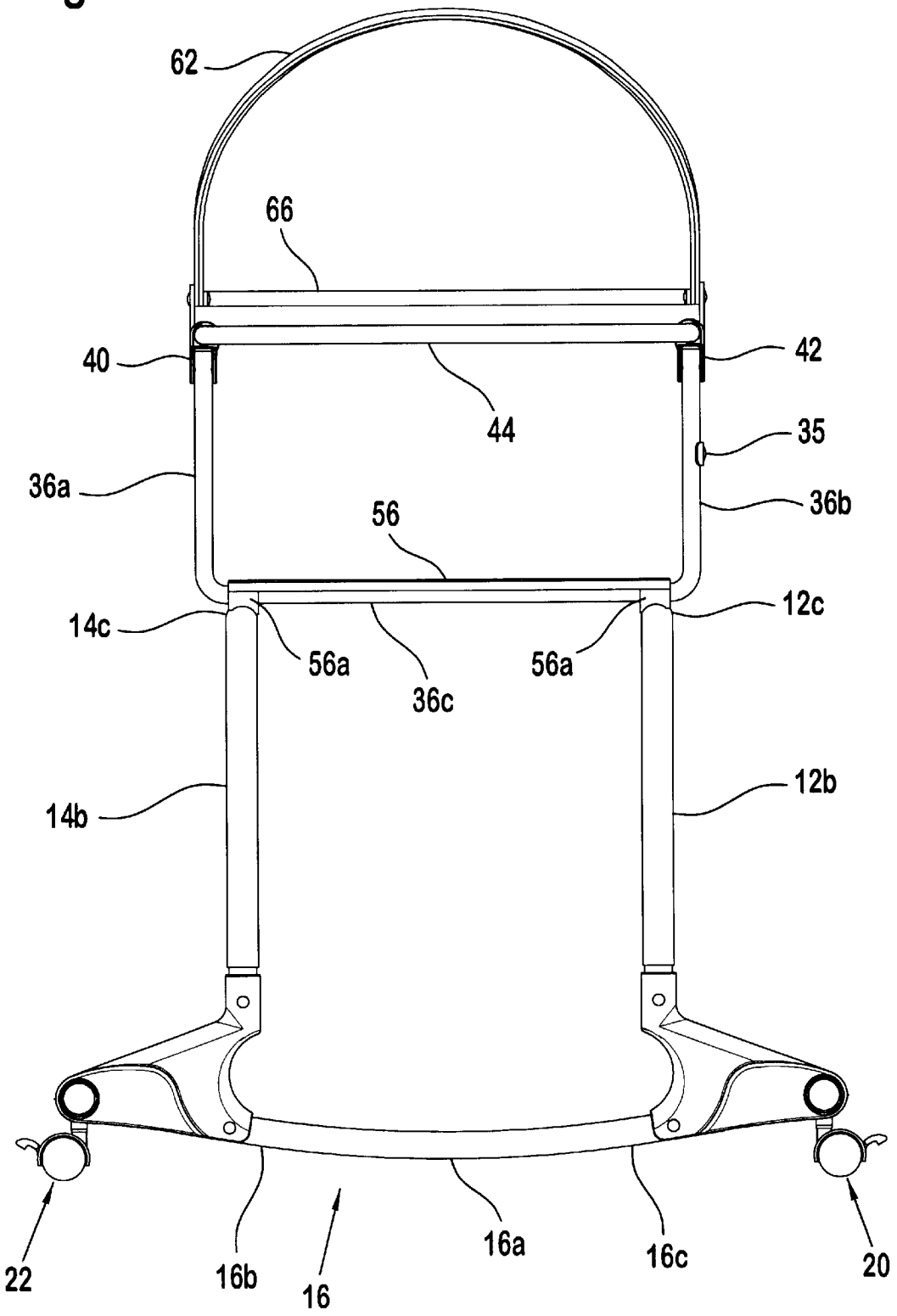

FIGS. 1*c* and 1*d* respectively show side and end views of the structure of FIG. 1*a*.

Figure 1E:
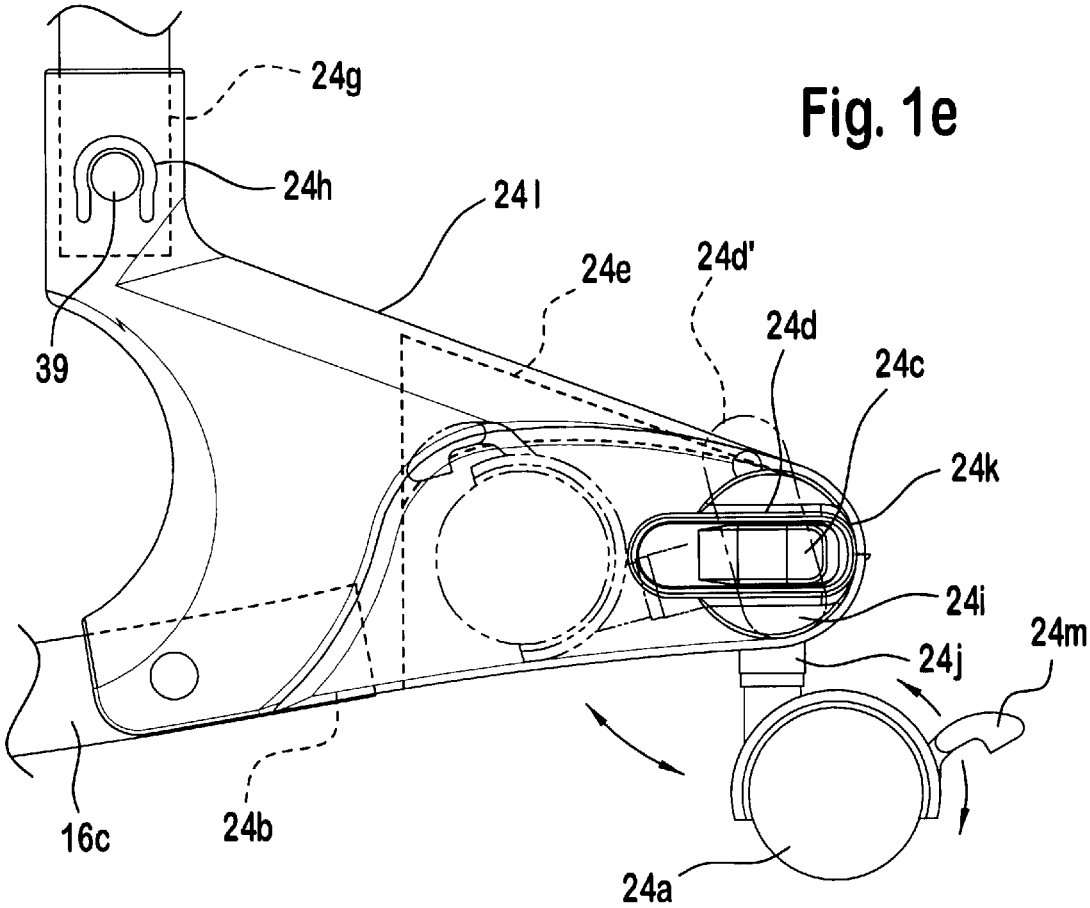

FIG. 1*e* draws a more detailed view of one of the wheel assemblies of FIGS. 1*a* and 1*b*.

Figure 1F:
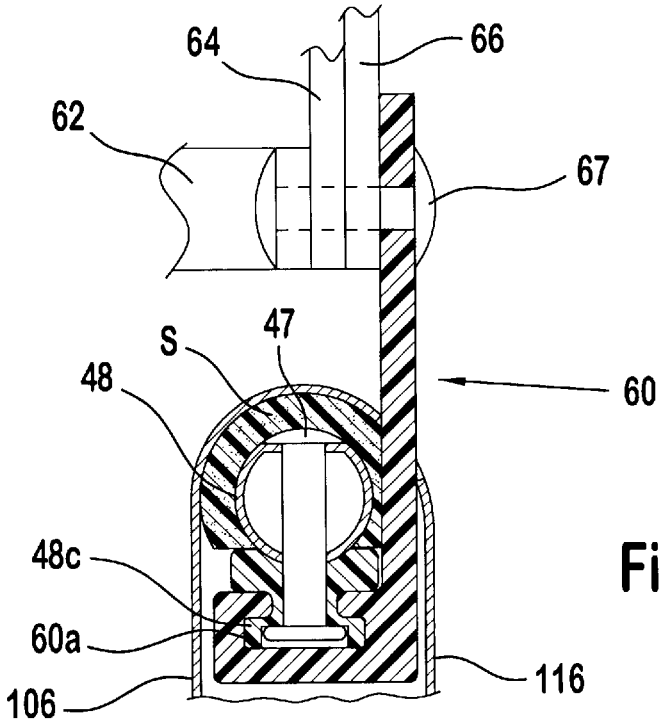

FIG. 1*f* is a detailed view of one of the brackets of FIG. 1*a*.

Figure 1G:
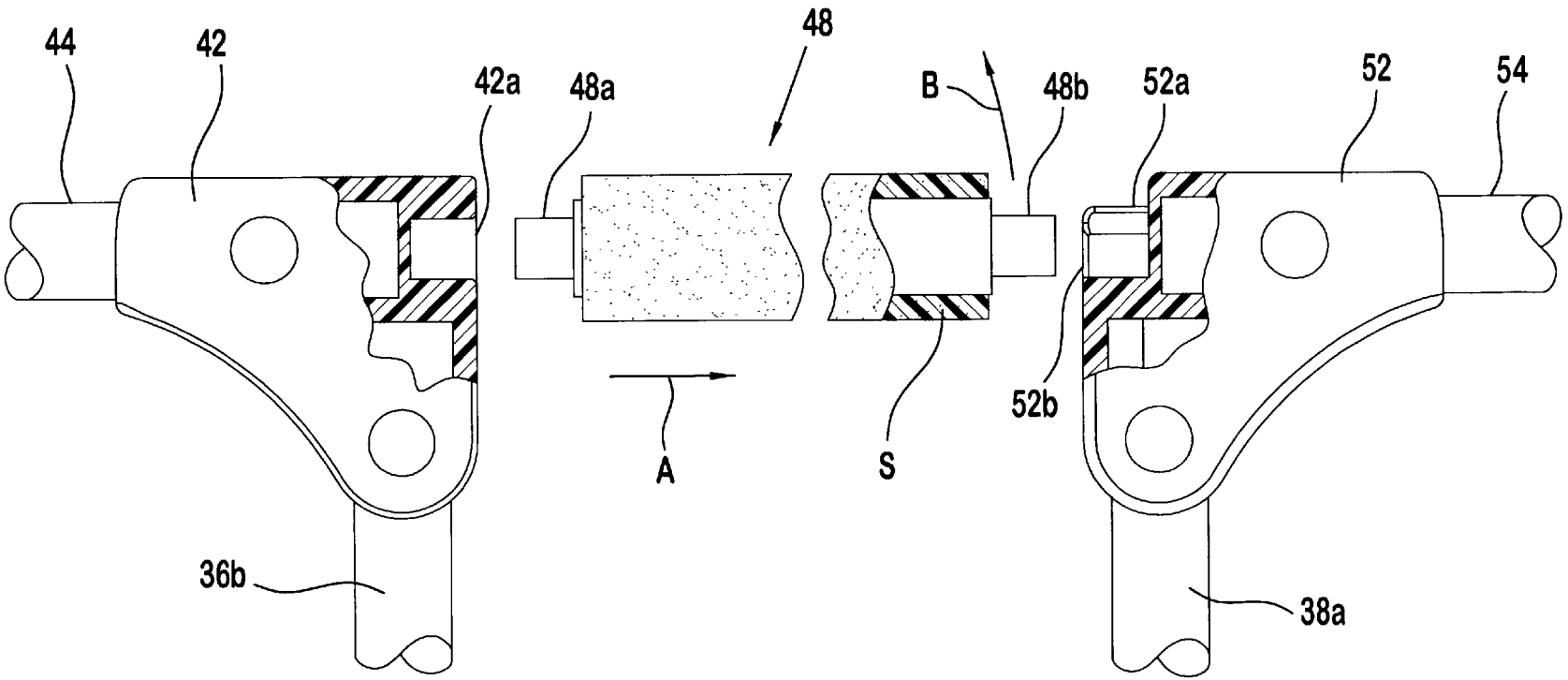
Figure 2:
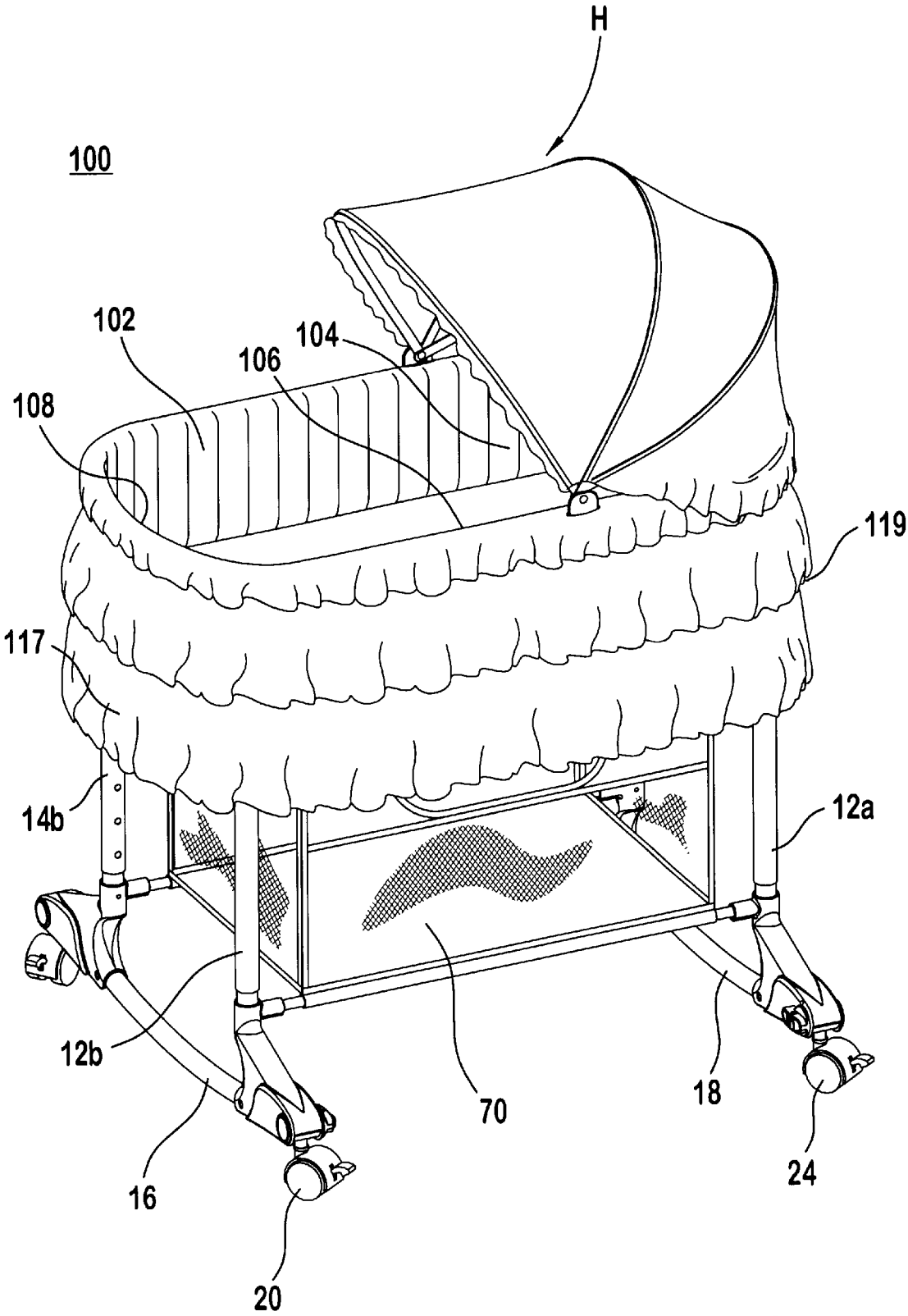

FIG. 1*g* is an exploded, detailed view of the removable rod of FIG. 1*a* and the cooperating brackets FIG. 2 is a perspective view showing the skeletal structure of FIG. 1 covered to form the 3-in-1 structure of the present invention.

Figure 3:
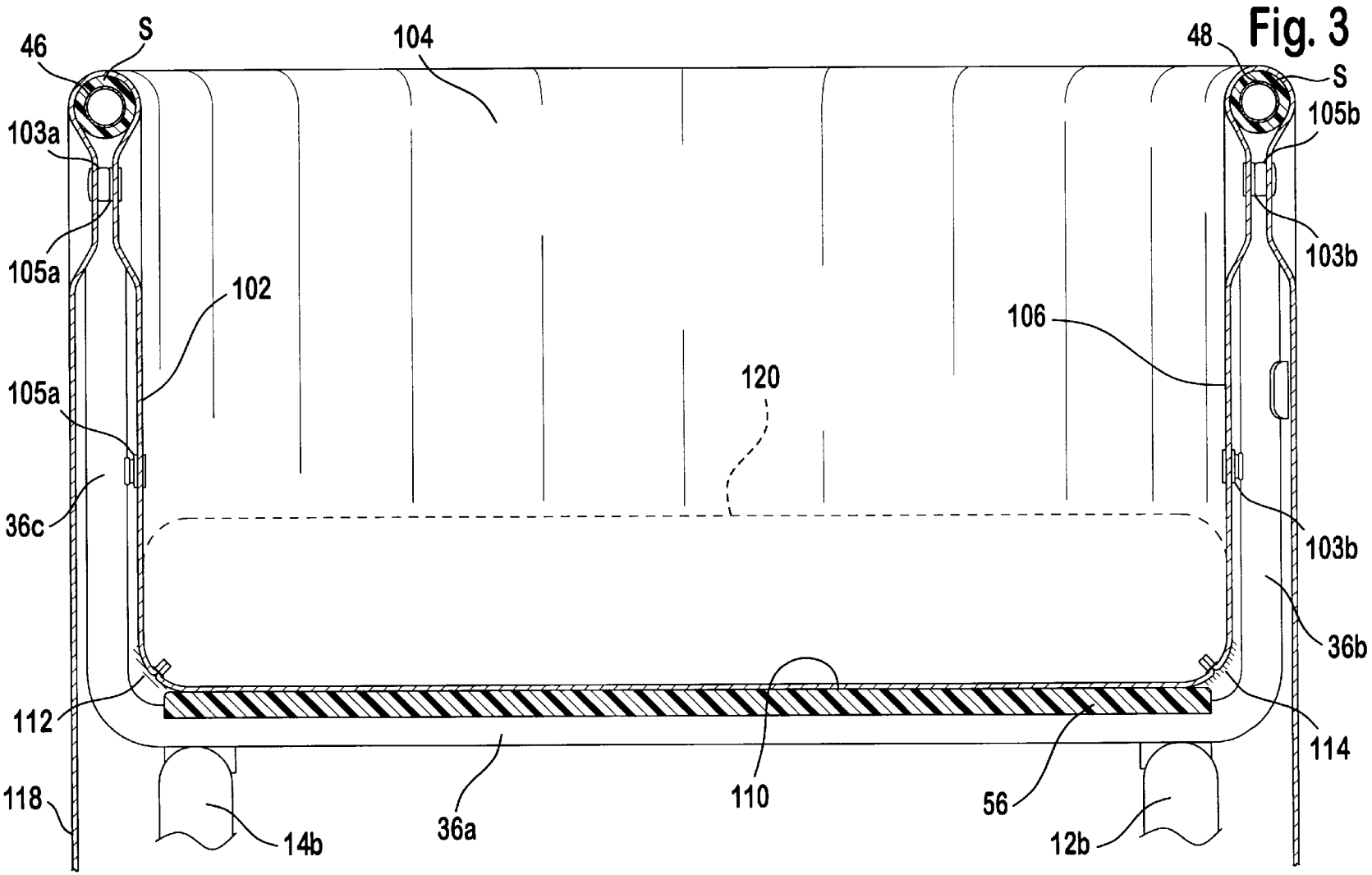

FIG. 3 shows a sectional view of the cover structure for covering the skeletal structure of FIG. 1*a*.

Figure 3A:
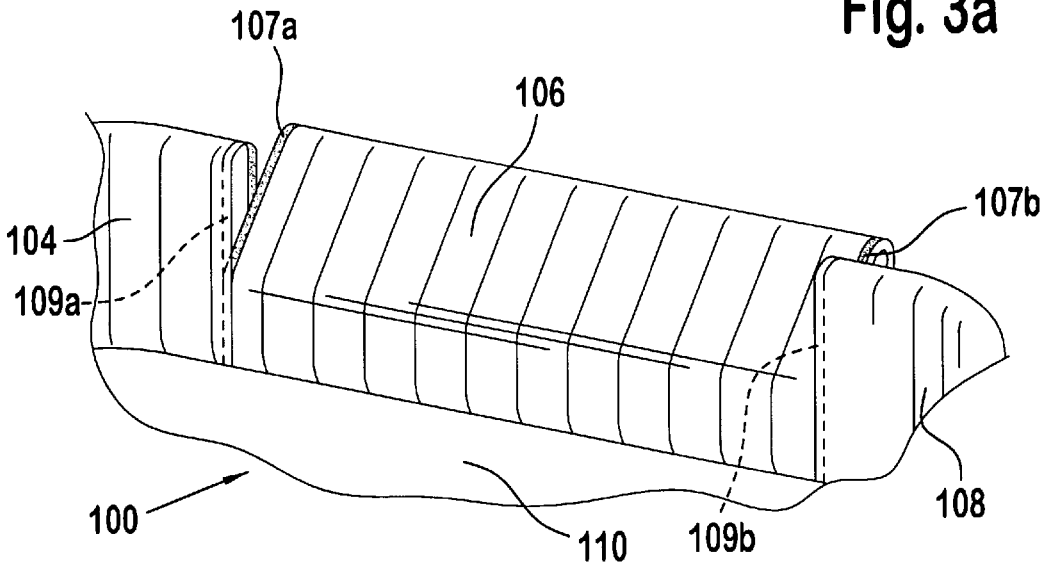

FIG. 3*a* is a perspective view of a portion of the cover structure showing the manner in which the cover structure converts from a bassinet to a co-sleeper.

Figure 3B:
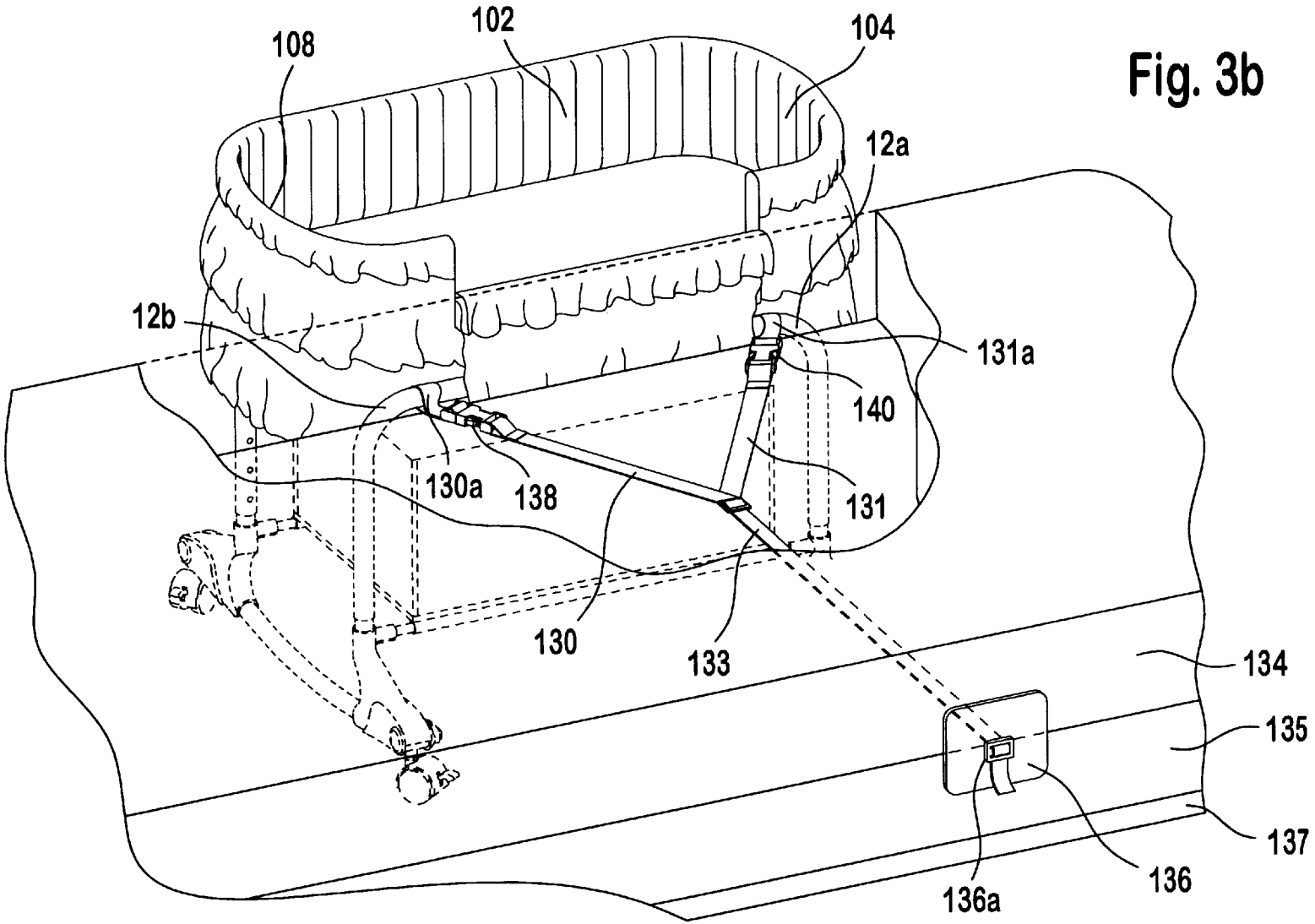

FIG. 3*b* is an elevational view showing the manner in which the co-sleeper is held against a parent's bed.

Figure 4:
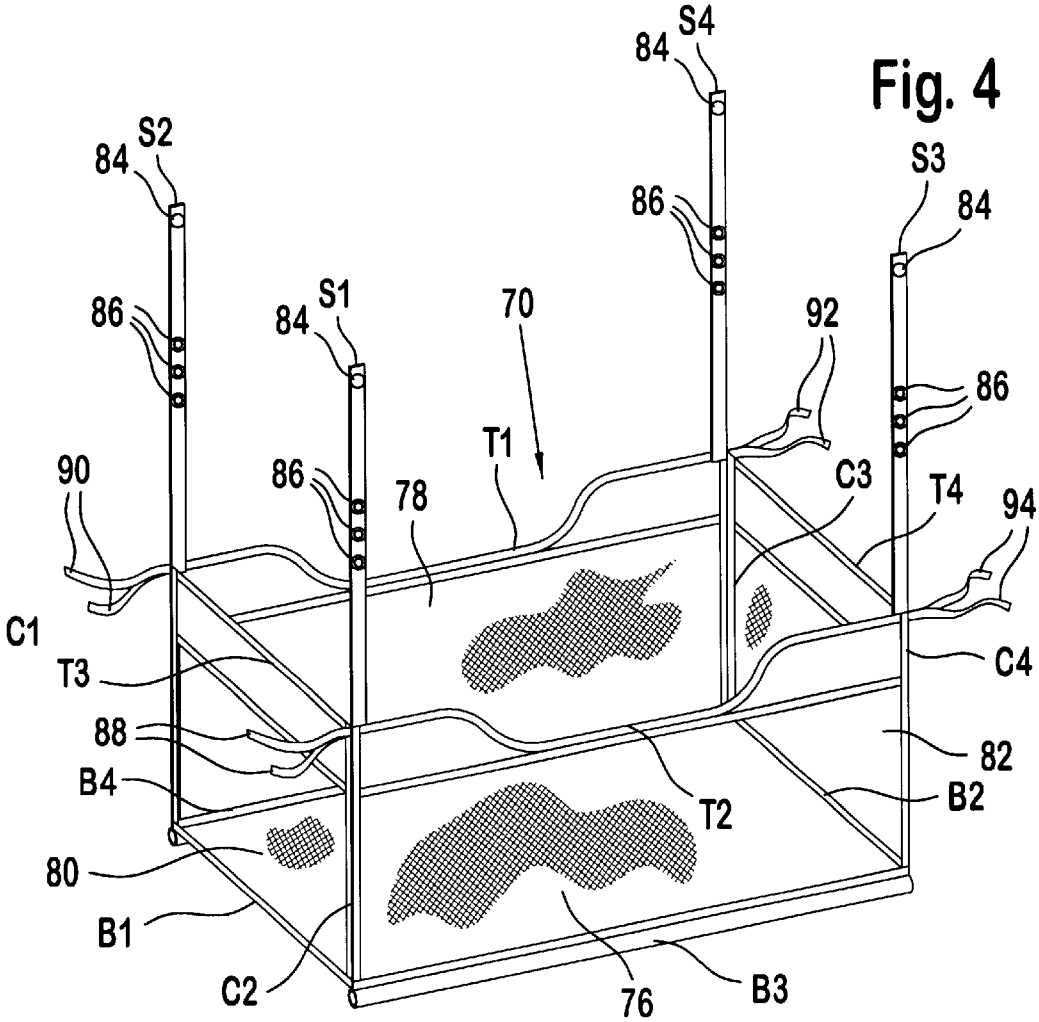

FIG. 4 is a perspective view of the storage basket shown in FIGS. 1*c* and 1*d*.

DETAILED DESCRIPTION OF THE PREFERRED EMBODIMENTS

FIGS. 1*a–d* and 3*d* show the skeletal structure 10 embodying the principles of the present invention and comprising a pair of inverted, substantially U-shaped, hollow, tubular members 12 and 14 respectively having depending legs 12*a*–12*b*, 14*a*–14*b* extending downwardly, and a yoke portion 12*c*, 14*c*.

A pair of hollow curved tubular members 16, 18 are each joined to retractable wheel assemblies 20–22 and 24–26 respectively mounted at opposite ends thereof.

The retractable wheel assemblies, as shown in FIG. 1*d* are each provided with a recess for receiving an end 16*b*, 16*c* of a curved member 16. The tubular member 18 is secured to the wheel assemblies 24, 26 in like fashion to that shown in FIG. 1*d*.

FIG. 1*e* is a detailed view of one wheel assembly 24 showing the recess 24*b* for receiving an end of tubular member 18. The retractable wheels shown in FIG. 1*a*, are in the "down" position where the skeletal structure is capable of being easily rolled along a surface. The wheels are moved upwardly to a retracted position by operating a toggle button 24*c* and an operating lever 24*d* surrounding toggle switch

24*c*. Toggle button 24*c* pivots about a vertical axis A and is normally urged into a locked position. Pushing button 24*c* at the right-hand end unlocks the castor assembly 24*a*, allowing lever 24*d* to be rotated in order to rotate caster 24*a* clockwise about the disc-shaped portion 24*i* at the upper end of the arm 24*j* holding caster 24*a*, disc-shaped portion being swingably mounted within an opening 24*b* in housing 24*l*. Lowering the caster 24*a* is performed by operating the toggle button in a similar manner, however, the lever 24*d* is rotated counter-clockwise to lower the caster 24*a*. When pressure on the right-hand end of toggle button 24*c* is released, the toggle button returns to the locked condition. Moving the casters 20*a*, 22*a* 24*a*, 26*a* into their recesses enables the skeletal structure to be rocked by the curved convex central portions 16*a*, 18*a* of tubular members 16, 18. Even though the wheels 20*a*, 22*a*, 24*a* and 26*a* are retracted, the underside of their housings such as 16*b*, 16*c*, can engage the surface supporting the skeletal structure, preventing the structure, when it is rocked, from toppling over (see FIG. 1*d*). The wheel assemblies are provided with conventional locking members, such as the slide switch 24*f* (not shown in detail for purposes of simplicity), which, when moved in one direction, lock the wheels 22*a*–26*a* from rolling when they are in the "down" position. Sliding the switch 24*f* in the opposite direction unlocks the wheels allowing them to roll freely. The outwardly projecting housings for the wheels provide a wider "footprint" to greatly enhance the stability of the skeletal structure.

Wheel assemblies 20–26 are further provided with integral, upwardly directed, hollow tubular projections 20*g*–26*g* (see FIG. 1*e*) each adapted to receive the lower end of one of the elongated, hollow, tubular, upright members 28–30 and 32–34, which extend into the hollow projections 20*g*–26*g* of assemblies 20–26. The upper ends of tubular members 28–34 each telescope into a lower end of one of the legs 12*b*–14*b*, 12*a*–14*a*. The legs 12*b*–14*b*, 12*a*–14*a* are provided with an array of spaced openings, such as, for example, the openings O shown provided on legs 14*a*, 14*b*, for purposes of receiving a conventional spring loaded button B provided on an upper end of each tubular member which locks into one of the openings provided on each leg, enabling the tubular members 12 and 14 to be raised (or lowered) to a desired height. The legs of each tubular member 28–34 can be adjusted simply by pressing the buttons B inwardly so that they are cleared of the openings O and moving the members 12 and 14 relative to the members 28–30 and 32–34. As soon as the spring loaded button B aligns with an opening, the spring loaded button B will snap into the opening and lock the associated leg at a desired height. All of the buttons B for each of the remaining three legs operate in a similar manner.

Integral hollow projections 29–33 provided on assemblies 22, 20 receive a rod 37 which provides additional structural support. A similar rod 39 extends between similar integral, hollow projections 31–35 to provide similar structural support. Rods 39 and 37 are snap-filled into the projections and extend through sleeves B3, B4 in storage basket 70, shown in FIGS. 1*c*, 1*d* and 4. The basket 70 is formed of a light-weight, open weave, mesh fabric which enables the contents of the basket to be easily observed through the side panels 76, 78 and end panels 80, 82 The vertically aligned corners C1-C4 are each comprised of strips formed of a suitable, rugged, tight-weave, durable fabric to support the basket. Bottom end strips B1 and B2 are similar to strips C1-C4. Likewise top side strips T1, T2 and top end strips T3, T4 each serve to rigidify the basket to assist in retaining its rectangular, box-like shape. The elongated strips T1-T4, C1-C4 and B1-B4 are preferably formed of more rugged, tightly-woven, rugged, strips of material which are sewn to the mesh material to form a basket.

The basket 70 makes excellent use of the open region beneath board 56 supported by tubular members 36, 38. The basket 70 is suspended from the skeletal structure by means of four (4) elongated straps S1-S4 arranged in each of the four corners of the basket 70. The straps are each provided with a plurality of spaced, female snap members 84. One of the snaps 84 is snap-fitted with a cooperating male snap member 86 each male snap member being provided at opposite ends of yokes 12*c*, 14*c* (see FIG. 1*c*). The female snap member 84 which is snap-fitted to member 86 is chosen so as to keep the basket 70 upright and suitably taut.

Pairs of tie members 80, 90, 92 and 94 are provided at the upper corners of basket 70 and are tied about the upper portions of legs 12*a*–12*b*, 14*a*–14*b* to hold the basket taut in the horizontal direction.

The pair of upright, substantially U-shaped tubular members 36, 38 have yoke portions 36*a*, 38*a* resting upon the yoke portions 12*c*, 14*c* and preferably joined thereto, for example, by suitable fasteners, which also secure the board 56 thereto. Standoffs 56*a* maintain board 56 parallel to yokes 12*c* and 14*c*, see FIGS. 1*c* and 1*d*. Members 36 and 38 are arranged substantially at right angles to yokes 12*c* and 14*c*. Member 36 has upwardly directed arms 36*b*, 36*c* and member 38 has upwardly directed arms 38*b*, 38*c*. Brackets 40 and 42 join the free ends of 44*a*, 44*b* of the curved tubular member 44 and first ends 46*a*, 48*a* of straight tubular members 46 and 48 to the upright arms 36*a* and 36*b*. Similar brackets 50, 52 join the opposite ends 46*b*, 48*b* of tubular members 46 and 48 and the free ends 54*a*, 54*b* of curved tubular member 54 to the upright arms 38*b*, 38*c*. The tubular members 44 and 36*b* are pivotally mounted to bracket 42 to allow these members to fold into a compact arrangement when disassembled and stored. The brackets 40, 50 and 52 are similar in design and function.

Rigid board 56 is secured to the yoke portions 36*a*, 38*a* of tubular members 36 and 38 by the aforementioned suitable fasteners (not shown) and serves as the base of the bassinet/changing table/bedside sleeper and as a support for a mattress 120 (FIG. 3).

Brackets 58 and 60 are releasably, mounted to locking projections arranged on the underside of rods 46, 48, For example, FIG. 1*f* shows rod 48, having cooperating projection 48*c* secured to rod 48 by pin 49. Bracket 60 has a cooperating slot 60*a* which is slidably mounted upon projection 48*c*. The free ends of curved gusset members 62, 64 and 66 are pivotally mounted upon the brackets 58, 60 by pin 67. Gusset members 62, 64 and 66 serve as the means for supporting a hood H (see FIG. 2) to shield the infants' eyes from overhead light, as will be more fully described. The brackets 58, 60 which slidably mount to the rods 46, 48 as set forth above, may be removed by sliding the brackets 60 away from the projections, such as projection 48*c*, enabling the canopy H to be easily removed/replaced. The gussets 62–66 are swingably mounted to brackets 58–60 to enable hood H to be easily raised and lowered.

The tubular members 35, 44, 46 & 48 are preferably enclosed in elongated, resilient, foam-type, plastic sleeves, such as sleeve S, shown in FIG. 1*f*, to cushion these rods and reduce injury to an infant or other person engaging these rods.

FIG. 2 shows the skeletal structure 10 covered with a fabric member 100. Making reference to FIG. 3 as well as FIG. 2, the fabric member 100 is comprised of interior sidewalls, FIG. 2 showing two (2) straight sidewalls 102, 106 and two (2) curved sidewalls 104, 108. The straight sidewalls 102, 106, shown in the sectional view of FIG. 3, as well as curved sidewall 104, have their lower ends joined, preferably by being sewn, to a bottom sheet 110. The sewn portions joining sidewalls 102 and 106 to the bottom sheet are shown at 112 and 114. The two curved sidewalls 104 and 108 are joined in a like manner, being sewn to the outer perimeter of bottom sheet 110.

Bottom sheet 110 rests upon the upper surface of board 56. A mattress 120 (shown in dotted fashion), is placed upon bottom sheet 110.

The upper ends of straight sidewalls 102 and 106 respectively rest on rods 46 and 48 and a portion of their free ends are each sewn to an integral skirt portions 118, 116 which skirt portions hang downwardly preferably to a point below the board 56. The short sidewalls are likewise joined to skirt portions 117, 119 in a like manner, as by sewing.

The surfaces 102*a* and 106*a* of the sidewalls 102 and 106 are provided with male-type snap buttons 103*a*, 103*b*. The surfaces 118*a*, 116*a* are each provided with male-type snap buttons 105*a*, 105*b*. The buttons 105*a*, 105*b* are arranged to be snap-fitted with buttons 103*a*, 103*b*. It should be understood that a plurality of pairs of cooperating snap-buttons 103*a*, 103*b* and 105*a*, 105*b* are arranged at spaced intervals along the straight sidewalls 102, 106 (as well as curved sidewalls 104 and 108), all of which pairs are snap-fitted together to retain the cover member in place draped over the skeletal frame. If desired, cooperating loop-type and hook-type strips may be substituted for the buttons without any change in effectiveness.

The placement of the mattress 120 upon the bottom sheet 110 cooperates with the button pairs to retain the cover member 100 in place.

The sidewall 106 of cover member 110 is capable of being pulled away from the adjacent curved sidewalls 104, 108. As shown in FIG. 3*a*, which shows lower portions of the skirt removed to assist in an understanding of FIG. 3*a*, ends of the straight sidewall 106 are each provided with elongated hook-type strips 107*a*, 107*b* which are aligned to be joined with elongated loop-type strips 109*a*, 109*b*, shown in dotted fashion, along adjacent ends of the curved sidewalls 104, 108.

In order to convert the bassinet to a beside co-sleeper, the gussets 62–66 are removed by removing the brackets 58 and 60, brackets 58 and 60 being slidably joined to projections on the rods 46 and 48. The fabric member 100 is provided with elongated slits aligned with the projections on rods 46 and 48 for receiving the brackets 58, 60 and to enable the brackets 58 and 60 to be easily assembled or disassembled from the aforesaid cooperating projections.

End 48*a* of rod 48 has a reduced diameter and is removably insertable into opening 42*a* in bracket 42, as shown in FIG. 1*g*. Opposite end 48*b* also has a reduced diameter and is longer than end 48*a*. End 48*b* is snap-fittingly received in the substantially U-shaped projection 52*a* at the end of bracket 52. In order to remove rod 48, after removal of bracket 60 and lifting of the skirt portion 108 (see FIG. 3*a*), end 48*b* is lifted upward in the direction of arrow B and out of the projection 52*a*. When end 48*b* is released from the reduced diameter portion 52*b* of projection 52*a*, rod 48 is moved in the direction of arrow A to remove end 48*a* from opening 42*a*.

Rod 48 is replaced by inserting end 48*a* into opening 42*a* and then lowering end 48*b* into projection 52*a* until end 48*b* moves below the reduced diameter portion 52*b*, causing end 48*b* to be snap-fitted into the projection 52*a*.

Rod 48 is removed by lifting end 48*b* upwardly and out of a locking recess in bracket 52, similar to the locking recess 24*h* on wheel assembly 24 (see FIG. 1*e*), and sliding rod 48 to the right out of the interior of bracket 42 until its left-hand end clears a receiving opening bracket 52, at which time the rod 48 may be removed. As a safety feature, rod 35 has both of its ends secured to arms 36*b*, 38*a*. The distance between rod 35 and board 56 is sufficiently small to prevent an infant's head from becoming wedged between rod 35 and board 56, while providing a barrier to prevent an infant from rolling out of the bassinet, even though rod 48 is removed.

Prior to removal of rod 48, the skirt portion 116 joined to straight sidewall 106 is lifted to gain access to rod 48.

After the brackets 58, 60 and rod 48 are removed, the ends of straight sidewall 106 are pulled away from adjacent curved sidewalls 104, 108 causing the cooperating button pairs to be moved apart to allow the straight sidewall 106 to be lowered and draped over rod 35, providing easier access to the interior of the sleeper while still providing a barrier (rod 35) to prevent an infant from rolling out of the beside co-sleeper. The thick, quilted sidewall 106, together with the resilient sleeves (see sleeve S in FIG. 1*f*), acts as a cushion to protect the infant from injury.

When the skirt portion 106 is pulled over the lower rod 35, the upper flounce portion 106*a* of skirt portion 106 is preferably aligned with the lower flounce position of the adjacent skirt portions, to enhance the aesthetic appearance even when the rod 48 is removed.

FIG. 3*b* shows the manner in which the co-sleeper may be retained against one side of an adult bed B. An elongated pair of straps 130, 131 each have loops 130*a*, 131*a*, provided at their free ends. The legs 12*a*–12*b* are preferably respectively passed through loops 130*a*, 131*a* when the skeletal structure is initially assembled. The straps 130, 131 are joined to a strap, 133, which is preferably passed between the mattress 134 and box spring 135 (or between the mattress 135 and bed frame 137). A flat, rectangular-shaped anchoring member 136 having slot through which the strap 133 is threaded 134, when aligned vertically, bridges across the region between and presses against the mattress and box spring 135 and rests against portions of the mattress and box spring. An adjustable, slidable locking member 136*a* allows the strap 133 to be tightened, holding the beside sleeper in place against the left-handed side of the bed and holds the anchoring member in place against the right-hand side of the bed. It should be understood that the casters should be in the down position with the casters locked to prevent rolling.

The loops 130*a*, 131*a* of straps 130, 131 shown in FIG. 3*b* maybe released from the strap by conventional clip assemblies 138, 140, to allow the unit to be moved away from the adult bed without disturbing the straps 130, 131 and 133 and the anchoring member 136.

The sidewall 106 may be placed either over rod 35 or rod 48 when employed as a changing table. The height of the changing table may be raised or lowered to assure a comfortable height for use as a changing table.

The gussets 62–66 are covered with hood H, which is formed of an aesthetically pleasing fabric, to shade the infant's eyes from bright light and having elongated passageways (not shown) for receiving and concealing the gussets.

The convertible apparatus may be easily and quickly assembled and disassembled. When disassembled, the apparatus fits into a compact space and is easily transported due to the light-weight and yet rugged materials which are preferably either aluminum or rugged plastic or a combination thereof.

What is claimed is:

1. Apparatus convertible into a bassinet, changing table and co-sleeper, comprising:

an infant support member of a size sufficient to accommodate and support an infant mounted upon a base of a support structure;

a substantially continuous oval-shaped support rail supported a spaced distance above the infant support member by support arms extending upwardly from said support structure;

a cover sheet supported by said support rail and extending downwardly on opposite sides of said support rail;

a portion of said cover sheet facing said infant support member defining sidewalls surrounding said infant support member;

another portion of said cover sheet facing away from said infant support member forming a decorative skirt for concealing said support structure;

facing surfaces of said cover sheet sidewalls and said skirt having cooperating fastening members for retaining the cover sheet upon said support rail when pressed together;

a lower support structure supporting said support structure;

two pairs of caster assemblies coupled to said lower support structure enabling the apparatus to be rolled upon a support surface; and said caster assemblies each having a retractable wheel which is selectively drawn into an associated wheel housing in a first position and projects downwardly from said housing when in a second position.

2. The convertible apparatus of claim 1 further comprising:

arcuate-shaped rocker members each arranged between a pair of said caster assemblies and having a smooth, curved convex surface for engaging a support surface enabling the apparatus to be rocked when said wheels are in said first position.

3. The convertible apparatus of claim 2 wherein said wheel housings project outwardly and away from said rocker members, whereby pairs of said wheels extend beyond the lower support structure to enhance the stability of the convertible apparatus.

4. The convertible apparatus of claim 3, wherein ends of said wheel housings are positioned to engage a supporting surface on which the convertible apparatus is placed to prevent the convertible apparatus from tipping over when rocked.

5. The convertible apparatus of claim 1 wherein said support rail has a removable section comprising an elongated rod supported between a pair of brackets coupling the support rail to the support structure:

said cover sheet having a portion of said sidewall supported by said removable rod being releaseably secured to sidewall portions on opposite sides of the sidewall portion supported by said removable rod to enable the sidewall portion to be lowered and to be supported by a fixed rod arranged a spaced distance below said removable rod and secured to the support arms of the support structure to facilitate access to a interior region of the convertible apparatus surrounded by the sidewalls of said cover sheet.

6. The convertible apparatus of claim 5 wherein opposite vertically aligned ends of the sidewall portion of the cover sheet supported by said removable rod are aligned with vertically aligned ends of said adjacent sidewall portions;

the aligned ends of the sidewall portion supported by said removable rod and said adjacent sidewall portions sections are respectively provided with strips of hook-type and loop-type material being joined when pressed together and are pulled apart to facilitate separation of said sidewall portions from one another to facilitate lowering of the sidewall portion supported by the removable rod to a position whereby it is supported by said fixed support rod.

7. The convertible apparatus of claim 1 wherein said support structure comprises a pair of substantially U-shaped, hollow tubular members each having a yoke portion supporting said infant support member and integral, upwardly extending arms; and brackets joining said support rail to said support arms.

8. The convertible apparatus of claim 2 wherein said lower support structure comprises a pair of inverted substantially U-shaped, hollow tubular members each having a yoke portion supporting said upper support structure, and downwardly extending arms.

9. The convertible apparatus of claim 8 wherein said rocker members are each provided with a pair of projections telescopingly received in an associated one of said downwardly extending tubular legs;

said downwardly extending tubular legs each having a plurality of openings at spaced intervals; and said elongated projections each having a spring-loaded button member being snapped into an opening of said downwardly extending hollow tubular legs when aligned therewith to adjust a height of the convertible apparatus.

10. The convertible apparatus of claim 1 further comprising a storage basket formed of a flexible fabric material, a pair of parallel sides of said basket having sleeves formed therein each receiving an elongated rod joined to a pair of said legs to support a bottom surface of said basket;

corner sections of said storage basket each having a mounting strap; and said straps each being fastened to one of said support structures for supporting the basket and retaining the basket in a upright position.

11. The convertible apparatus of claim 1 further comprising a collapsible hood releaseably joined to said support rail for shading one end of said convertible apparatus and having gussets swingable between an upper position above said support rail and a lower position adjacent said support rail; and a fabric cover member supported by said gussets.

12. The convertible apparatus of claim 11 wherein said collapsible hood is joined to said support rail by a pair of releaseably mounted brackets.

13. The convertible apparatus of claim 1 wherein said cover sheet has a central portion joined to a lower end of said sidewalls;

said central portion resting upon an upper surface of said infant support member.

14. The convertible apparatus of claim 13 further comprising a mattress placed upon the central portion of said cover sheet, said infant support member supporting said cover sheet central portion and said mattress.

15. The convertible apparatus of claim 5 wherein the pair of brackets supporting the removable rod each has an opening to receive an end of said removable rod;

said removable rod having a spring-loaded button near one end thereof;

one of said brackets having a locking opening inward from a free end receiving said removable rod and communicating with said opening receiving said removable rod;

said spring-loaded button on said removable rod being snapped into said locking opening when aligned therewith to retain the removable rod supported by said pair of brackets.

16. The convertible apparatus of claim 1 wherein said support rail and a perimeter of said infant support member have an oval shape.

17. The convertible apparatus of claim 8 wherein said support structures are formed of a strong light-weight material including one of a plastic and metal material.

18. The convertible apparatus of claim 8 wherein said support structures are removably joined to one another by fasteners enabling the convertible apparatus to be compactly packaged in a disassembled state and be easily assembled.

19. A combination bassinet, changing table and bedside sleeper structure comprising:

a board supporting a mattress;

a frame surrounding said board and having an upper cover-supporting portion extending above said board;

a cover draped over said frame and said board and resting on said cover supporting portion, a support for said frame and board having adjustable legs for adjusting a height of said board and frame; and said frame having a removable rod along one side of said cover-supporting portion to reduce a height of said cover-supporting portion along said one side of said frame.

20. The combination structure of claim 19 further comprising a fixed rod joined to said frame along said one side of said frame and extending above said board and below said cover-supporting portion to provide a barrier at said one side to prevent an infant resting on said board from rolling off of said board.

21. The combination of claim 20 wherein said cover sheet is provided with a portion thereof aligned with said one side of said frame which is releasably joined to the remainder of the cover sheet to enable the portion of the cover sheet to be lowered so as to be draped over the fixed rod.

22. The combination structure of claim 19 wherein said legs are provided with retractable wheel assemblies for rollingly supporting said structure when in a down position and for enabling curved rocking members joined to said legs to rockingly support said structure when said wheels are retracted to an up position.

23. The combination of claim 22 wherein said wheels are each provided with releaseable locking means for locking said wheels when in a first position and for releasing said wheels to roll freely on a supporting surface when in a second position.

24. The combination structure of claim 19 further comprising a strap assembly coupled to said structure and adapted for positioning beneath a mattress of an adult bed for securing said structure in place with said one side having said removable rod facing the adult bed.

25. The combination structure of claim 24 wherein said strap assembly comprises a pair of loops encircling portions of said frame; and releasable clip assemblies between said loops and a remainder of said strap for releasing said loops from said remainder of said strap without removing the remainder of said strap from beneath said mattress.

26. Apparatus convertible into a bassinet, changing table and co-sleeper, comprising:

a support member of a size sufficient to accommodate and support an infant;

a continuous sidewall arranged upon and surrounding said support member and having a substantially continuous oval-shaped rail a spaced distance above the support member and defining an upper edge of the continuous sidewall;

a lower support structure supporting said support member;

said rail having a removable section comprising an elongated rod;

a portion of said sidewall aligned with the removable section being folded down to a level of a fixed member arranged a spaced distance below said removable rod and above said support member to facilitate access to a interior region of the convertible apparatus surrounded by the continuous sidewall.

27. The apparatus of claim 26 wherein said lower support structure is adjustable to adjust a height of the lower support structure to adjust a height of said fixed bar relative to a top of an adult bed.

28. The apparatus of claim 27 further comprising a device for releaseably attaching the lower support to the adult bed.

29. The apparatus of claim 26 wherein said lower support structure is adjustable to adjust a height of the lower support structure to adjust to a height of an adult to facilitate use of the convertible apparatus as a changing table.

30. The apparatus of claim 26 wherein said support member is removably mounted upon said lower support structure.

31. The apparatus of claim 26 wherein said lower support structure is provided with wheel assemblies each having a selectively lockable wheel.

32. The apparatus of claim 31 wherein the lower support is provided with curved rocking members to enable rocking of the lower support by lifting the wheel assemblies.

* * * * *

UNITED STATES PATENT AND TRADEMARK OFFICE

CERTIFICATE OF CORRECTION

PATENT NO. : 6,704,949 B2
APPLICATION NO. : 10/103580
DATED : March 16, 2004
INVENTOR(S) : Waldman et al.

It is certified that error appears in the above-identified patent and that said Letters Patent is hereby corrected as shown below:

On the title page, at item (75), Inventors, delete "Dropinski" and insert therefor --Drobinski--.

Signed and Sealed this

Twenty-fourth Day of October, 2006

JON W. DUDAS
*Director of the United States Patent and Trademark Office*